United States Patent [19]

Baader

[11] 3,968,358

[45] July 6, 1976

[54] WARNING LIGHT ASSEMBLY

[76] Inventor: Joseph E. Baader, 333 Holiday Drive, Springfield, Ohio 45505

[22] Filed: May 21, 1975

[21] Appl. No.: 579,750

[52] U.S. Cl. ..... 240/41.55; 240/41.3; 340/84

[51] Int. Cl.[2] ..... F21V 17/00

[58] Field of Search ..... 240/22, 41.3, 41.5, 240/41.55; 340/84

[56] References Cited

UNITED STATES PATENTS

| | | | |
|---|---|---|---|
| 2,852,758 | 9/1958 | Beaubien | 340/74 |
| 2,979,603 | 4/1961 | Falge | 240/41.5 |
| 3,025,390 | 3/1962 | Woodcock | 240/41.5 |
| 3,105,642 | 10/1963 | Worden | 240/41.5 |
| 3,177,356 | 4/1965 | Worden | 240/41.5 |
| 3,280,323 | 10/1966 | Pawlowski | 240/90 |
| 3,651,321 | 3/1972 | Magi | 240/151 |
| 3,676,666 | 7/1972 | White | 240/41.5 |

*Primary Examiner*—Monroe H. Hayes
*Attorney, Agent, or Firm*—David H. Semmes

[57] ABSTRACT

An improved signal light assembly having particular utility as a school bus warning light which is a one piece housing of a plastic material which includes a sealed cup-shaped body to receive a general service sealed light bulb. The sealed beamed bulb is held by integrally formed plastic tabs which are formed extending from a flanged surface around the housing and allow especially advantageous positioning and securing of the sealed lamp in accordance with all SAE photometric tests and standards. The lens mounted upon the housing further includes a series of bosses which have bulb locating surfaces intricately formed thereon to further secure and position the sealed lamp.

9 Claims, 4 Drawing Figures

WARNING LIGHT ASSEMBLY

BACKGROUND OF THE INVENTION

1. Field of Invention

Warning lights are commonly used on automotive vehicles such as school busses to provide a highly visible visual warning means. Performance criteria for school bus signal lamps have been standardized by the SAE through its published standard SAE J887. School bus signal lamps are alternately flashing lamps which are mounted horizontally both front and rear and intended to identify a vehicle as a school bus while informing other users of a highway that a vehicle is stopped on a highway in order to discharge school children. The SAE has promulgated standards which warning lights such as those used on school busses must meet, among them are vibration tests, moisture tests, dust tests and corrosion tests for the entire assembly.

Of the tests required, one of the most stringent are the photometric tests which must be performed pursuant to J of SAE J575. In order to assure that the effective projected illuminated area when measured on a plane at right angles to the axis of the lamp will be not less than 19 square inches, the juxtapositioning of the sealed light bulb within the housing and lens superstructure must be accurately maintained. Any aiming of the warning light assemblies done through external aiming pads on the outer surface of the lens which are suitable for use with a mechanical head lamp aimer.

Because of these voluntary standards, which have in many cases been adopted or expanded upon by state regulatory authorities to cover the performance characteristics of warning lights, particularly for school busses, there has existed a need for a unitary assembly which economically and reliably ensures specification requirements.

2. Description of the Prior Art

Exemplary of a common type of mounting for a warning light such as required in a school bus warning light assembly is that illustrated in FIG. 1, and labeled as prior art. According to this conventional assembly there is a housing which is invariably metallic with an opening 14 for the projecting connectors of the general service sealed light. In order to hold the sealed light unit 12 securely within the housing, the prior art has commonly employed discrete and separate bulb hold down brackets 6 which are required to be manually applied over the retaining flange of the sealed light bulb with separate fasteners 8.

At this point, it is pertinent to note that the general service sealed light illustrated at 12 in FIG. 1 is also illustrated in an embodiment according to the present invention at FIG. 3 and reference will be made to FIG. 3 for purposes of explaining further considerations dictating the only approved manner of mounting a sealed light bulb. General service sealed lighting units are themselves the subject of a SAE standard. According to the SAE recommended practice, as delineated in SAE J760, a sealed lamp 12 includes a lamp seal 33 which includes an annular bulb retaining flange 34 on an upper surface and further includes a lower lamp edge seal 37 which is spaced outwardly from a further seating plane which is defined with an edge 35. The lamp seal 33 itself will vary in contour and thickness and should in no case be used for seating and holding purposes. The lamp itself must be held between the seating plane 35 and the retainer flange 34 without reliance upon the particular contour of the lamp seal 33 itself. The lamp seal as defined between surfaces 34 and 37 itself includes a manufacturing tolerance of ±0.040 inches. To compound the dimensional problems, the outermost diameter of the seal 33 is, for a 5¾ inch diameter sealed lighting unit, nominally 5.700 ± .100 inches.

The lamp seal is not itself an allowable mounting surface and its tenth of an inch diameter tolerance, taken together with its allowed configuration contour, creates an alignment problem for any mounting system that is to be contemplated.

As illustrated at FIG. 1 the seating plane of the bulb is normally placed in contact with the metallic housing 4 with the provision of a gasket 16 relied upon for sealing the lamp housing itself against intrusion of water and dust from the interface of the lens and the housing 4. Such a gasket 16 normally abuts against the seal 33 and is relied upon to prevent water from seeping in from the elements around the lens. In the manufacturing process a manual assembly of the bulb 12 with manual positioning of the bulb against the seating rim of the housing ensured only by a worker using the individual brackets 6 and tightening them with separate bulb hold down screw 8. A second manufacturing assembly step is positioning the lens to with hold down screws 10 extending through a series of bosses which have to be lined up with openings found drilled through the metal housing flange. Finally, other bosses are provided with holes for mounting screws 18 which extend through further bosses and holes within the metal housing and are adaptable to be secured into the sheet metal of the vehicle body. In the final application the sealed beam electrical connections 20 are exposed through an opening or housing access as illustrated at 14 and require electrical connection to be made during mechanical placement of the assembly on the vehicle body, with the attendant likelihood of damage to the electrical connectors 20 from an inadvertent contact with part of the vehicle.

SUMMARY OF INVENTION

The present invention provides a particularly improved structure which represents an improvement in performance as well as assembly economies hereinbefore unobtainable in the manufacture of warning lights for vehicles. Through the novel combination of structure according to the instant invention sealed light bulbs of indeterminate tolerances will be securely and accurately positioned within the combination housing and lens superstructure as further disclosed herein. Through the novel combination of structure herein, a sealed light beam is held within integrally formed tabs with angled bulb contacting surfaces wherein the housing lens also includes locating pins for accurate positioning of a lens superstructure. The lens superstructure itself mates with the locating pins and further includes a plurality of bulb locating bosses defining inwardly directed bulb locating surfaces which cooperate with the resilient tabs to cooperatively or independently maintain the photometric alignment of the sealed light unit within the entire assembly.

Because the lens superstructure is itself used as a mounting and locating element for the sealed light unit, in the event that any or all of the intricately formed tabs are broken the provision of structure inwardly directed from the lens bosses is sufficient by itself to maintain the bulb positionment.

A further advantageous feature of the total assembly is the provision of a resilient gasket which extends inwardly over the rim of the housing so as to provide a deformable region between the seating plane of the sealed light and the rim of the housing. By extending the gasket inwardly of the rim the sponge-like gasket acts as a further resilient member to maintain a compression on the bulb between the contact surface and the rim of the housing.

A further advantage of the assembly as taught herein is that if the gasket is misplaced or omitted the juxtapositioning of the resilient tab from the housing rim together with the positioning of the inwardly directed bulb locating boss, either alone or in combination, will ensure that the bulb seating plane contacts the housing.

A further advantageous feature according to the instant invention is the enclosing of the fragile sealed beam electrical connections in a unitary housing, with electrical connections being made on the bulb before it is placed within the housing. By providing wire access holes of diameter substantially identical to the outer diameter of the insulated connecting wire, the rear of the housing is further sealed from the elements to ensure manifest compliance with the above-noted recommended practices of the SAE.

DESCRIPTION OF THE PREFERRED EMBODIMENT

Figure 1:
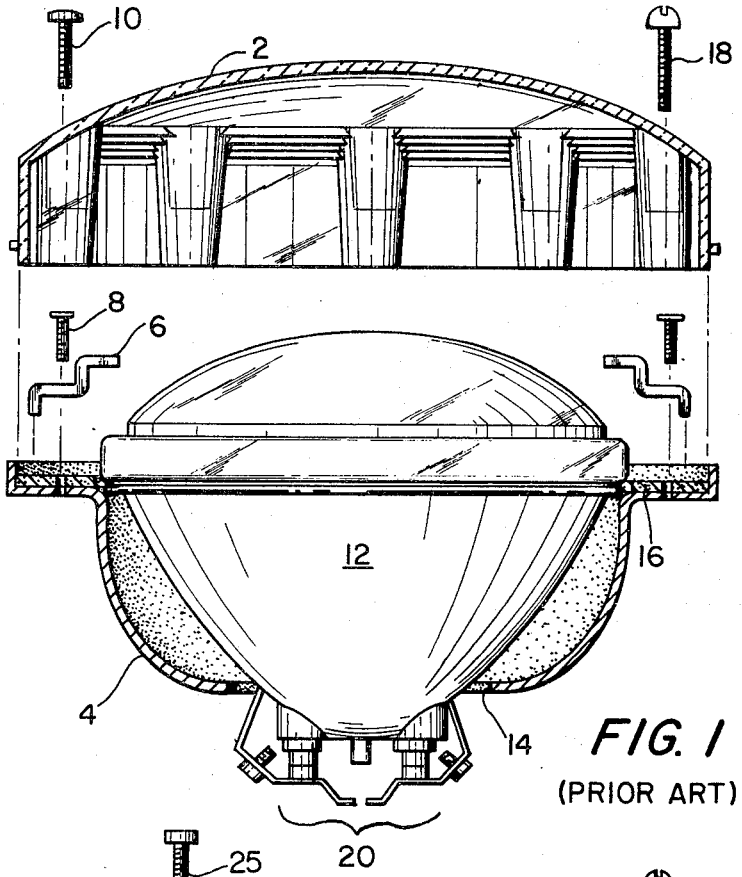
FIG. 1 (PRIOR ART)
FIG. 1 schematically illustrates in cross-section a prior art warning light assembly.

Referring now more particularly to the drawings, as hereinabove has been discussed, FIG. 1 illustrates a representative prior art device wherein a sealed light bulb is held within a housing through the selective application of bulb hold down brackets 6 which are applied separately before a lens may be placed upon the housing. As can be seen in FIG. 1, there are clear disadvantages to the metallic housing design in that inaccuracy in applying the individual brackets 6 will result in a misalignment of the bulb, and a bulb which has been positioned within the housing is not an operative assembly. In order to be rendered operative, the sealed beam electrical connections must be made; these connections are exposed to the elements existing within the body of the vehicles. As a result, rust and corrosion around the intravehicular structure is visited upon the bulb connections as well as the interior space of the housing through the access opening 14. Water is allowed to condense upon the lower half of the bulb 12 and bulb hold down screws 8 are necessarily extended through gasket 16 and into and through the metallic housing flange to be exposed on the opposite side of the flange. As a result, the commonly used sheet metal screw 8 presents an unwanted extension against the vehicular body.

Figure 2:
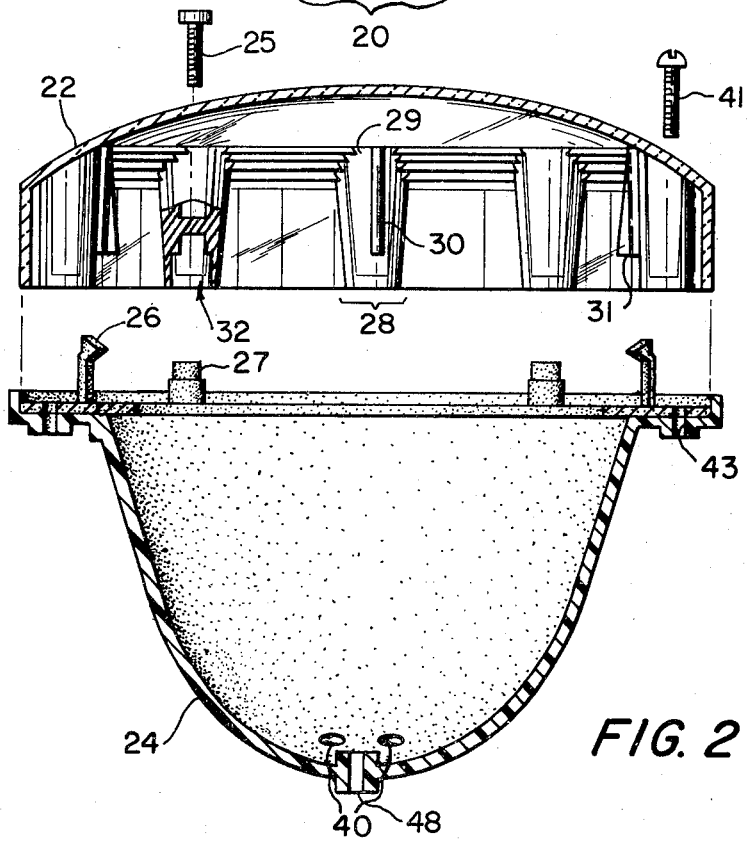
FIG. 2 schematically illustrates a side-view of the preferred embodiment according to the invention with section views illustrating various internal features.
Figure 3:
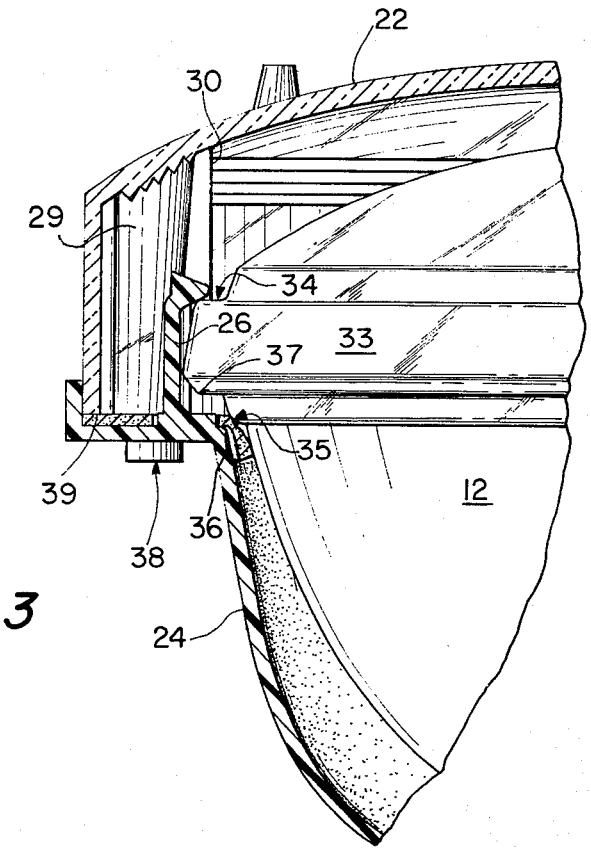
FIG. 3 schematically illustrates a cross-section view of the juxtapositioning of a light bulb within the present invention.

Referring now to the preferred embodiment of the invention, FIG. 2 illustrates all the required elements for accurately securing a sealed lamp within a unitary plastic housing. The combined lens and support superstructure 22 is a concave surface which terminates, at FIG. 3, in an annular lens mounting surface 39 which contacts the flange through the gasket 35. The concave inner surface of the lens further comprises a plurality of bosses extending from the periphery of the inner lens surface and includes a plurality of combination bosses as labeled 28. The combination boss 28 is structurally similar to the other bosses in that it includes a boss 29 which extends from the inner periphery of the lens surface and terminates at the plane of the annular mounting surface 39. The combination bosses differ with the provision of an additional configuration 30 which includes a bulb locating surface 31 at the bottom thereof. The bulb locating portion 30 itself extends radially inwardly from the boss 29 and the one bulb locating surface 31 is spaced a specific distance from the surface defining the lens mounting surface 39. This spaced distance is the nominal distance which has been hereinafter indicated as the standardized dimension between the bulb retaining flange 34 and the seating plane 35. The recommended manufacturing tolerance between retaining flange 34 and seating plane 35 has been indicated as +—0.040 inches and the distance from the bulb locating surface 31 to the lens bottom surface 39 is advantageously this nominal dimension.

The one piece plastic housing is defined as a cup-shaped body having a symmetrical concave inner surface which terminates at a rim generally indicated at 36. The seating plane of the bulb 35 is substantially the same diameter as the circular rim 36 so that the gasket 35 is locally compressed as the integrally formed tabs 26 include an angled surface extending radially inwardly which is adapted through its inclined configuration to position itself upon the bulb retaining flange regardless of slight manufacturing tolerances to the bulb retaining flange. As has been noted, these integrally formed tabs comprise an elongated shaft which is positioned at a diameter greater than the maximum possible bulb seal diameter so as to accommodate the seal configuration of the various bulb manufacturers. The gasket 35 extends inwardly over the rim between the inner concave surface and the flange and serves both as the seal between the lens and the mounting rim 39 in the plastic housing and the means to maintain the bulb containing flange 34 resiliently urged against the inclined surface of the plastic tab 26. As is apparent from the geometry illustrated in FIG. 3, if the gasket 35 is not present the bulb will seat directly upon rim 36, being resiliently urged thereagainst by the contact with the resilient tab 26. As a result, while the gasket is advantageously employed within the total assembly, the misalignment of the gasket, and/or its omission, does not defeat the maintenance of the bulb 12 within the housing.

Figure 4:
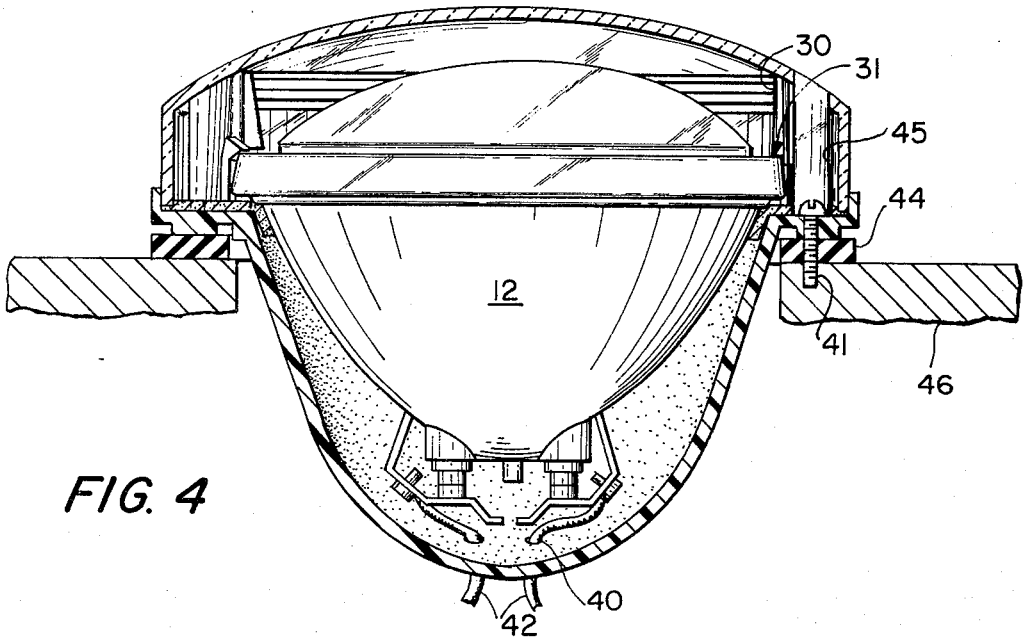
FIG. 4 illustrates a mounting of an assembled warning light according to the present invention within a particular body section.

As shown most clearly in FIG. 4, the bulb locating surface 31 is also spaced the nominal distance of the dimension defined by bulb retaining flange surface 34 and bulb seating plane 35. While the resilient tabs are themselves sufficient to support the bulb in its required position, the locating surface 31 further remains proximate the bulb retaining flange 34 to supply a redundant means of locating the bulb.

The locating pins also integrally formed within the flange are configured to require that the lens be positioned so that the conical opening within certain of the lens bosses, necessarily will have to be lined up upon these locating pins. According to the preferred embodiment, the locating pins supply a sufficient amount of housing material in and of themselves so that the lens hold down screw 25 does not of necessity have to extend below the lower edge of the mounting flange. Consequently, the provision of the locating pin 27 has the advantageous function of supplying an alignment means which also avoids the hazard of a sheet metal screw point being exposed below the bottom of the flange. The entire assembly is advantageously mounted upon a body, such as a school bus, through sheet metal screws shown at 41 which extend completely through one or more of the combination bosses 28. As illustrated in FIG. 4 the boss includes a hollow access through the entire lens structure for access to the screw 41. With a conventional rubber gasket 44 the assembly is mounted upon a school bus body as in this preferred embodiment allowing the lens to be removed without necessity of removing the entire assembly from the vehicular body. Consistent with the desired result of maintaining the housing free of moisture and dust intrusion, the electrical connector wires 42 are snugly pulled through the housing holes 40. Because the outer diameter of the wires are the same as the diameter of the access holes 40, the bulb may be removed from the mounted housing assembly by simply pulling the wires 42 through the holes 40, while maintaining a fairly effective barrier against unnecessary water and dirt entrance. Holes 48 may also be provided with bosses to support a fiber optic bundle for determining light condition. Various details in construction can be effected in the shown and described embodiment without departing from the spirit and scope of the invention as defined in, and limited solely by, the appended claims.

I claim:

1. A signal light assembly, of particular utility as a school bus warning light, comprising in combination:

A. A one-piece housing of a resilient material further comprising a cup-shaped body having a concave inner surface terminating at a circular rim and housing rim means further including an annular housing flange surface around and in the plane of said rim, said one piece housing further including a plurality of individual integrally formed resilient tabs, each tab comprising an elongated shaft extending substantially normally from said annular flange surface and with an inwardly directed projection surface on the distal end of said elongated shaft, and;

B. a general service sealed light bulb of the type having a circumferential lamp seal defining an upper retaining flange and with a lower seating plane surface, said bulb including electrical terminals on the rear thereof, wherein said bulb is held within said housing with said seating plane in contact with said housing rim means and said upper retaining flange in contact with at least one of said resilient tab projection surfaces, and;

C. a lens superstructure comprising a concave inner surface terminating at an annular lens mounting surface, said lens further comprising a plurality of bosses formed extending from the periphery of said inner lens surface, wherein at least one of said bosses is a combination boss including a bulb locating surface spaced from said annular lens mounting surface, whereby when said lens mounting surface is held against said housing rim means said bulb locating surface is proximate said bulb retaining flange.

2. A signal light assembly as in claim 1 wherein said housing rim means further includes a compressible lens gasket upon said annular housing flange surface and extending radially inwardly between said bulb seating plane and said circular rim.

3. A signal light assembly as in claim 1 wherein said plurality of integrally formed resilient housing tabs are three in number and are equally spaced around said circular rim.

4. A signal light assembly as in claim 1 wherein said plurality of lens bosses are eight in number with alternate bosses defining said at least one combination boss.

5. A signal light assembly as in claim 1 wherein said one-piece housing further includes opening surfaces defining wire access holes proximate said bulb electrical terminals.

6. A signal light assembly as in claim 5 wherein two of said opening surfaces define circular holes having a diameter substantially equal to the outer diameter of insulated wire adapted to be connected to said terminals and extended outwardly through said access holes, and one hole includes bosses operable to support a fiber optic bundle.

7. A signal light assembly as in claim 1 wherein said lens is lenticulated and of the type known as a school bus warning light lens.

8. A signal light assembly as in claim 1 wherein said annular housing flange surface further includes a plurality of normally extending locating pins, said pins respectively mating with certain of said plurality of lens bosses.

9. A signal light assembly comprising in combination:

A. a one-piece housing of a resilient material comprising a symmetrical concave inner surface adapted to receive a general service sealed light bulb and a substantially annular flange means extending radially outward in a first plane substantially radial to the axis of symmetry of said concave surface, said housing further comprising a plurality of integrally formed tabs extending from said flange means, each tab terminating with a radially inwardly extending surface, each extending surface equally spaced a first distance from said first plane, B. a lens structure comprising a concave inner surface and a substantially annular mounting surface adapted to mate with said substantially annular housing flange and including a plurality of integrally formed bosses extending from and around the periphery of said inner lens surface and terminating in the plane of said annular mounting surface, wherein at least one of said bosses further includes a bulb locating surface extending inwardly and spaced a second distance from said annular mounting surface, wherein said first distance and said second distance are substantially equal.

* * * * *